US008353115B2

(12) United States Patent
Steffens

(10) Patent No.: US 8,353,115 B2
(45) Date of Patent: Jan. 15, 2013

(54) EXHAUST AIR DRYER WITH A HEAT EXCHANGER

(75) Inventor: Günter Steffens, Dallgow-Döberitz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 672 days.

(21) Appl. No.: 12/497,005

(22) Filed: Jul. 2, 2009

(65) Prior Publication Data

US 2010/0005678 A1 Jan. 14, 2010

(30) Foreign Application Priority Data

Jul. 11, 2008 (DE) ..... 10 2008 032 801

(51) Int. Cl.

| | |
|---|---|
| ***F26B 3/00*** | (2006.01) |
| ***F26B 19/00*** | (2006.01) |
| ***B05B 3/04*** | (2006.01) |
| ***A61M 11/06*** | (2006.01) |

(52) U.S. Cl. ..... 34/470; 34/79; 34/80; 239/102.1; 239/338

(58) Field of Classification Search ..... 34/76, 79, 34/80, 86, 470; 239/338, 60, 102.1, 102.2
See application file for complete search history.

(56) References Cited

U.S. PATENT DOCUMENTS

| | | | | |
|---|---|---|---|---|
| 7,494,532 | B2 * | 2/2009 | Azukizawa et al. | 96/27 |
| 7,921,578 | B2 * | 4/2011 | McAllister et al. | 34/597 |
| 2008/0289212 | A1 * | 11/2008 | Moon et al. | 34/267 |

FOREIGN PATENT DOCUMENTS

| | | | |
|---|---|---|---|
| DE | 3000865 | A1 | 7/1981 |
| DE | 19508244 | A1 | 9/1996 |
| DE | 19833775 | A1 | 2/2000 |
| DE | 10302864 | A1 | 8/2004 |
| DE | 102006003817 | A1 | 8/2007 |
| JP | 03036415 | A * | 2/1991 |

* cited by examiner

*Primary Examiner* — Kenneth Rinehart
*Assistant Examiner* — John McCormack
(74) *Attorney, Agent, or Firm* — James E. Howard; Andre Pallapies

(57) ABSTRACT

An exhaust air dryer includes a process airflow entering from outside as supply air, which removes moisture from laundry introduced in a treatment compartment and which emerges to the outside as exhaust air through an air outlet, a heat exchanger between the treatment compartment and the air outlet, seen in the airflow direction, which removes heat from the process airflow, while forming condensate, a dispersal device arranged downstream of the treatment compartment in the airflow direction and in front of the air outlet, which adds at least part of the formed condensate to the exhaust air, and a hydrophilic body belonging to the dispersal device, which projects into the process airflow and is impinged upon by condensate.

7 Claims, 2 Drawing Sheets

EXHAUST AIR DRYER WITH A HEAT EXCHANGER

BACKGROUND OF THE INVENTION

The invention relates to the field of treatment and care of laundry items, where in particular for drying purposes the laundry items are impinged upon by air-conveyed heat. It relates to an exhaust air dryer with a process airflow entering from outside as supply air, which removes moisture from laundry introduced into a treatment compartment, and which exits to the outside through an air outlet as exhaust air, with at least one heat exchanger arranged between the treatment compartment and the air outlet, seen in the airflow direction, which removes heat from the process airflow while forming condensate.

Such an exhaust air dryer is known from DE 30 00 865 A1. This exhaust air dryer enables at least partial recovery of heat from the exhaust air flowing from the laundry to be dried. This property of the exhaust air dryer, which is per se advantageous, is however achieved at the cost of the precipitation of condensate from the exhaust air in the heat exchanger, at which a transfer of heat from the exhaust air to the supply air takes place, said precipitation having to be collected and disposed of. Although it is true that this is also customary in the case of tumble dryers of other types, it means a noteworthy and under certain circumstances scarcely welcome complication of the operation of this exhaust air dryer.

Various tumble dryers for the drying of laundry have become known, which operate according to two methods differing in principle, namely according to the condensation procedure or the exhaust air procedure.

Condensation tumble dryers are in widespread use, and are popular in terms of energy-related aspects. Here the laundry to be dried is introduced into the stream of heated process air. The laundry can here be located in a drum or also in a static drying compartment, as described, for example, in DE 198 33 775 A1. After flowing through the drying compartment, which is also known as a treatment compartment, the moisture-laden process air is then passed through a condensation device, in which the moisture driven out of the laundry is separated out of the process air by means of cooling of the process air. The process air is located in a closed air circuit, and is then heated once more and conveyed to the treatment compartment.

It is characteristic of an exhaust air dryer that the process air fed in from outside as supply air is directed into the treatment compartment after heating, and there comes into contact with the laundry to be dried. After leaving the treatment compartment, the exhaust air stream flows out through an air outlet, transporting the absorbed moisture with it. A particular development of the exhaust air dryer is described in the aforementioned DE 30 00 865 A1. DE 10 2006 003 817 A1 describes a dryer and a method for the treatment of laundry, where both a variant of a condensation tumble dryer and an exhaust air dryer are described.

Exhaust air dryers of such a type are basically characterized by a particularly simple construction, though from the energy consumption perspective they are not optimal. Against this background, DE 10 2006 003 817 A1 mentions the use of a heat pump circuit, but without providing further details in connection with the exhaust air dryer. DE 10 2006 003 817 A1 further describes a moisture dispenser arranged downstream of the treatment compartment seen in the airflow direction, which serves further to reduce the temperature of the exhaust air, in order to realize comparatively high laundry treatment temperatures, without these high temperatures damaging the components located downstream of the process air. In the case of the exhaust air dryer, the user must regularly replenish the moisture dispenser, because otherwise the drying program is automatically terminated.

DE 195 08 244 A1 describes a condensation tumble dryer, in which the condensed water drips into a drip tray and is pumped into a condensate collector receptacle. In order to avoid relatively demanding fill-level monitoring of the collector receptacle and interruption of the drying process should the collector receptacle overflow, DE 195 08 244 A1 proposes that in the event of a malfunction—that is to say in the case of the undesired overflow of condensate fluid from the collector receptacle—this condensate fluid be fed into the cooling air or into the process circuit of the condensation tumble dryer. However in order to permit operation of this type in the event of a malfunction, the cooling air guide must be embodied accordingly and be able to discharge the used cooling air to a location which is not sensitive to moisture.

Finally a tumble dryer is known from DE 103 02 864 A1 which can be switched between circulation mode operation (as a condensation tumble dryer) and exhaust air operation, depending on the laundry to be treated, where the exhaust air operation preferably serves to freshen up and air laundry. In order that in the circulation mode too, additives sprayed into the treatment compartment are activated, or water can be used as heated steam for the purposes of disinfection, then in the case of the known dryer operating as a condensation tumble dryer, the condensate can be fed to a spray device, which sprays this into the treatment compartment (laundry drum) as steam or mist. In exhaust air mode on the other hand, the exhaust air duct is closed in the direction of the heat exchanger, and the process air instead flows out of an opened exhaust air flap, so that the air flow does not circulate.

BRIEF SUMMARY OF THE INVENTION

Against this background, one object of the present invention is the creation of an exhaust air dryer with a heat exchanger—in particular belonging to a heat pump—in which the condensate occurring is disposed of automatically and without burdening the user with operating actions such as the disposal of condensate or monitoring tasks.

Advantageous embodiments of the invention are specified in the following description, the features of which can be used individually and in any desired combination. In the case of the inventive exhaust air dryer, a process airflow thus entering from outside as supply air, which draws moisture from laundry introduced into a treatment compartment, and which exits as exhaust air through an air outlet is envisaged, and at least one heat exchanger arranged between the treatment compartment and the air outlet seen in the airflow direction, which removes heat from the process airflow while forming condensate. To this end a dispersal device is provided, downstream of the treatment compartment and in front of the air outlet seen in the airflow direction, which adds at least part of the condensate formed to the exhaust air, as is at least one hydrophilic body belonging to the dispersal device, which projects into the process airflow, and is impinged upon by condensate.

By means of the heat exchanger, of whatever type, a significantly improved energy balance can be expected in the case of the inventive exhaust air dryer, because the heat removed can, for example, be used to heat the supply air. In the case of the inventive exhaust air dryer it is additionally envisaged that a dispersal device is arranged downstream of the heat exchanger, but in front of the air outlet seen in the airflow direction, which adds at least part of the condensate to the exhaust air. Extra moisture or condensate is thus added to the cooled exhaust air stream, advantageously from an energy-related perspective, in order thereby to dispose of it from the exhaust air dryer, as it were in an elegant manner. It is particularly advantageous here if the dispersal device has at least one hydrophilic body, which projects into the process airflow, and is impinged upon by condensate.

Within the framework of the invention the term "hydrophilic body" is understood to mean any body having water-attracting and water-conveying properties. By means of the invention, the user is advantageously relieved of monitoring or disposal tasks during the drying process. The expectations of a user or purchaser of an exhaust air dryer are that basically no monitoring/maintenance activities are to be performed in the case of an exhaust air dryer during the drying process, and that at most, cleaning of the fluff filter between drying processes will be necessary.

Through the provision of the hydrophilic body, which significantly improves the dispersal of the condensate in the exhaust air, even in the case of the expected high incidence of condensate in the exhaust air with very damp or even wet laundry and high moisture saturation of the process airflow flowing from the laundry to be dried, sufficient dispersal capacity for disposal of the condensate is guaranteed. Optimum operation of the inventive exhaust air dryer for any operating status which can reasonably be expected is thus possible. In the inventive exhaust air dryer, the heat exchanger, if this is for example embodied to remove heat from the exhaust air and to heat the supply air as an air-to-air heat exchanger, and any additional electrical resistance heating to heat the supply air can be replaced by a compact heat pump, the air-to-air heat exchanger by a heat sink—which for its part is a heat exchanger—and the resistance heating by a heat source of the heat pump—where the heat source for its part is also a heat exchanger. The condensate occurring at the heat sink can be pumped into a storage container via a condensate pump in an essentially known manner, and then dispersed into the exhaust air stream by means of the dispersal device.

Particularly preferable is an embodiment of the inventive exhaust air dryer in which the dispersal device is arranged downstream of the heat exchanger in the airflow direction. In this manner a particularly favorable temperature regulation can be achieved in the exhaust air dryer and an undesirable influence of the condensate to be dispersed in the exhaust air on the operation of the heat exchanger avoided.

According to an advantageous embodiment of the invention, the dispersal device comprises an ultrasound nebulizer. In ultrasound nebulization, the condensate has energy applied to it by means of mechanical agitation and thereby transformed into ultra-fine droplets (mist), which can be efficiently entrained from the exhaust air stream.

According to an advantageous embodiment of the invention, provision is made for the body to be immersed in the condensate. This too serves to guarantee the maximum possible spreading capacity for removal of the condensate in the exhaust air.

Particularly preferably within the framework of the invention, the body is embodied in a plate-like form and thus positioned in the air stream such that the exhaust air flows over it via the largest possible vertical areas. The body thus significantly increases the evaporation surface exposed to the exhaust air for the condensate to be cold-evaporated.

According to a particularly preferred development of the invention, the body has capillaries, the capillary effect of which conveys condensate into the process airflow. By means of the internal capillary effect of the body, the water to be dispersed rises within the whole body without additional conveyance measures, and is then exposed to an intensive stream of air from both vertical sides of the body. Here, the hydrophilic body can preferably be immersed directly in the condensate and thereby convey condensate from the condensate supply directly into the process airflow.

According to an advantageous development of the invention, the body is an air-flow directing plate. The thinnest possible plates are preferable here. The plate height is embodied such that the capillary effect guarantees complete saturation or complete elevation of the water due to the capillary effect over the entire height of the plate. The plate or multiplicity of plates here serve to guarantee optimized guidance of the process airflow, so that the flow resistance remains low and the speed of flow is high. The windfall gain, the further dispersal of condensate preferably downstream of the hydrophilic body—for example by means of the aforementioned ultrasound nebulizer—is thereby significantly improved.

According to another advantageous development of the invention, the heat exchanger of the inventive exhaust air dryer is part of a heat pump. From the function of the heat exchanger described above it is evident that it must have the function of a heat sink in the heat pump, where it removes heat from the process airflow passing through it. This heat passes to a heat source in the heat pump, which disperses it again, in particular to the process airflow, in order to heat this before it reaches laundry to be dried. A heat pump of any known structural form can be employed. A heat pump is preferred in which a coolant circulates in a closed circuit, and is cyclically evaporated and condensed. The evaporation takes place in the heat sink designated as the "evaporator" in this connection, to which the liquid coolant is fed from a throttle. The coolant evaporated in the heat sink passes to a compressor, which compresses it and transfers it to the kinetic energy necessary for circulation. The compressed coolant reaches a heat source designated "condenser" in this connection, where it becomes liquid while giving off heat. Behind the heat source, the coolant the passes to the aforementioned throttle, where it reduces its internal pressure, in order finally to reach the heat sink once more, where it again evaporates. Such a heat pump is customarily referred to as a "compressor-heat pump". Coolants which come into consideration are fluorated derivates of ethane, in particular essentially known substances R134a and R152a, mixtures of such ethane derivatives and the essentially known R407C and R410A, as well as propane (R290) and carbon dioxide (R744).

DETAILED DESCRIPTION OF THE PRESENT INVENTION

Figure 1:
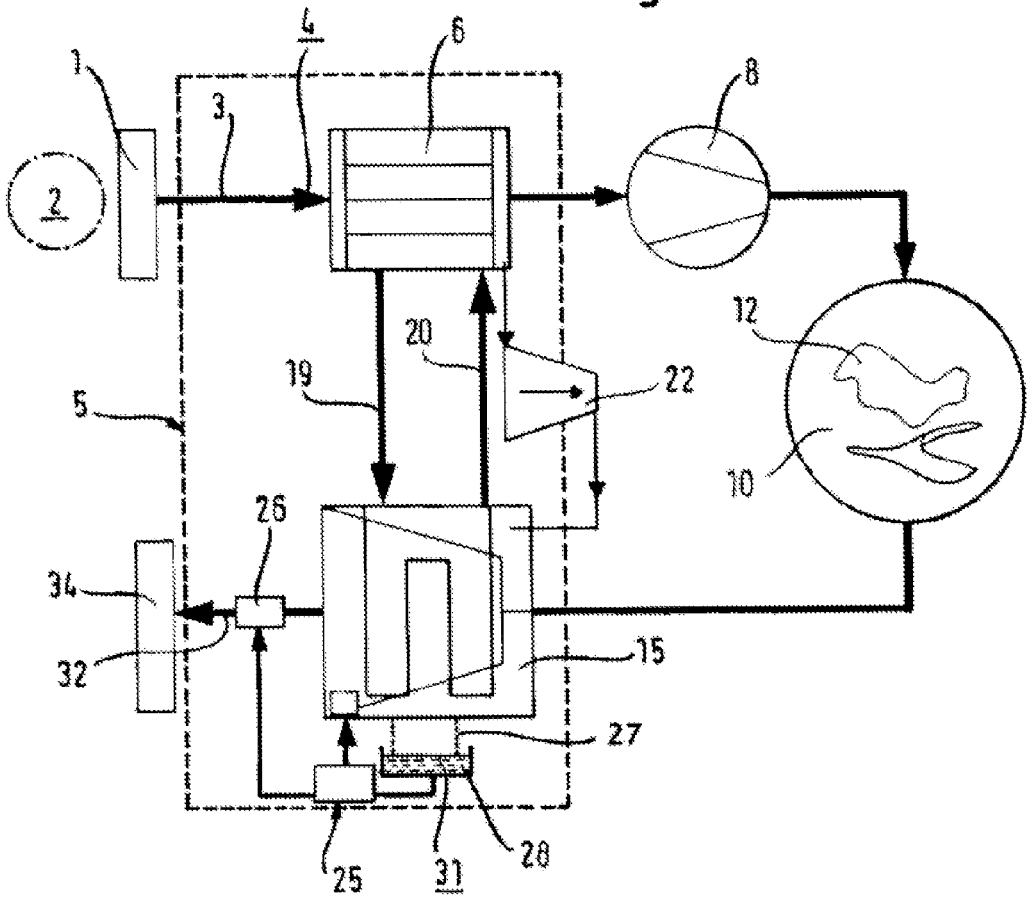
FIG. 1 shows a schematic diagram of an exhaust air dryer.

The invention is explained in more detail in the following on the basis of an exemplary embodiment represented in the drawings. Here the same elements or those with the same function are provided with the same reference numbers. Even if the following explanation refers to the exemplary embodiment represented in the drawing, the invention is in no way thereby restricted.

FIG. 1 represents only the components of an exhaust air dryer relevant to the direction of process air and the formation or dispersal of condensate. Ambient air 2 as supply air 3 enters through an air inlet 1, and thus serves as what is known as the process airflow 4. As the first component of an essentially known heat pump (generally designated 5) this passes through a first heat exchanger (condenser) 6. This transmits heat to the process airflow, as a result of which the latter heats up. A heating unit—for example electric—which is not represented here serves to provide further heating if applicable. The process airflow 4 is conducted by a fan 8 represented only in diagrammatic form. The fan 8 applies the now heated process air to the treatment compartment 10 which is embodied as a rotating laundry drum, which comes into contact with laundry items 12 in this treatment compartment. Here the process air absorbs moisture from the laundry in an essentially known manner, and is subsequently fed to a second heat exchanger in the form of an evaporator 15. This removes heat energy from the process airflow in an essentially known manner and in the function of a heat pump 5, which is indicated in FIG. 1 in a diagrammatic form by means of a heat cycle with arrows 19, 20. The heat removed (arrow 20) impinges upon the first heat exchanger 6 and is given off to the newly entered supply air. A compressor 22 for operation of the essentially known heat pump 5 (cf. DE 10 2005 062 940 A1) is represented in diagrammatic form. The condensate 28 precipitated during cooling of the process airflow at the evaporator 15 is conveyed to a dispersal device 25. In this example this dispersal device 25 has two dispersal elements 26 and 27 operating according to different principles, specifically an ultrasound nebulizer 26 and a hydrophilic body 27. The ultrasound nebulizer 26 is activated to oscillate and supplied with condensate 28 by the dispersal device 25.

Figure 2:
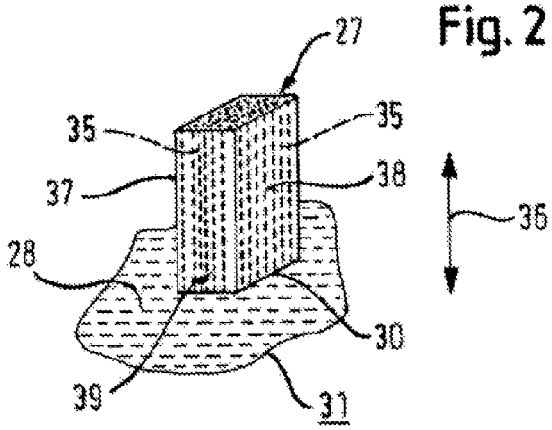
FIG. 2 shows a hydrophilic body.

As FIG. 2 shows in detail, the hydrophilic body 27 preferably stands with its foot 30 directly in the condensate supply 31. The exhaust air 32 thus applied with condensate by the dispersal device 25 leaves the exhaust air dryer through an air outlet 34. The hydrophilic body 27 comprises a porous material, perforated by a multiplicity of capillaries 35, in particular in the vertical direction 36, which is in flowing contact with a condensate collector receptacle. The capillary effect draws the condensate vertically upwards, so that it can in particular also emerge from the correspondingly large-area surfaces 37, 38 at the side of the body. The hydrophilic body 27 is embodied here in the form of an airflow-directing plate 39.

Figure 3:
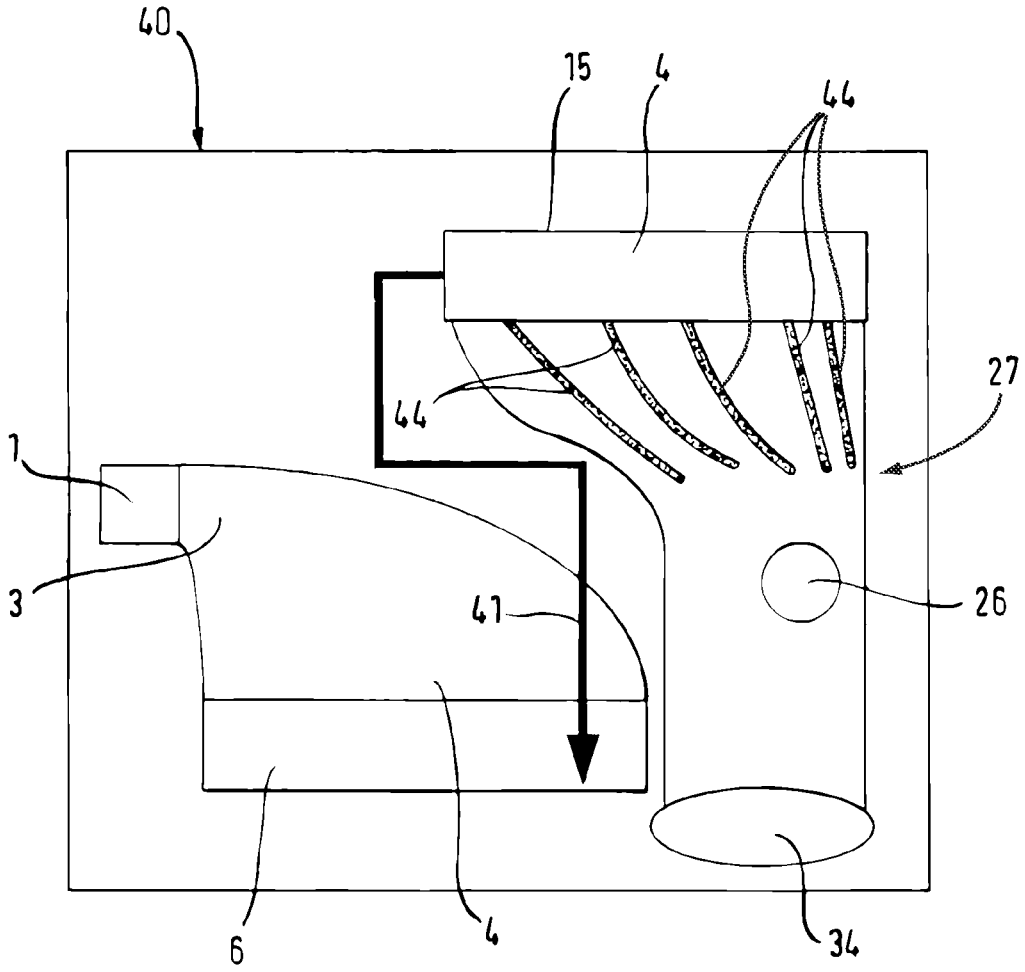
FIG. 3 shows a possible arrangement of individual components of an exhaust air dryer.

FIG. 3 essentially shows in schematic form a bottom view of an inventive exhaust air dryer 40, of which in turn only the particularly relevant components are represented in diagrammatic form. The supply air 3 entering through the air inlet 1 reaches the condenser 6 as process airflow 4 in an already described manner, in which the working medium of the heat pump, which is not further represented, emits heat into the process airflow in order to heat the supply air. The process airflow, which is directed though the treatment compartment (not shown in FIG. 3), is cooled in the evaporator 15 in the previously described manner, with the heat thereby being absorbed from the working medium of the heat pump again being directed to the condenser 6 via a connection 41. The condensate arising during cooling of the process airflow 4 impinges in part on a multiplicity of hydrophilic bodies 27, which are embodied as disks 44 in order to direct the process airflow and are in contact with the condensate in their foot areas. The ultrasound nebulizer 26 is also indicated, which is also preferably located downstream opposite the hydrophilic bodies 27. The exhaust air 32 laden there with further condensate leaves the exhaust air dryer 40 through the air outlet 34.

The invention claimed is:

1. An exhaust air dryer, comprising:

a process airflow entering from outside as supply air, which removes moisture from laundry introduced in a treatment compartment and which emerges to the outside as exhaust air through an air outlet;

a heat exchanger between the treatment compartment and the air outlet, seen in the airflow direction, which removes heat from the process airflow, while forming condensate;

a dispersal device arranged downstream of the treatment compartment in the airflow direction and in front of the air outlet, which adds at least part of the formed condensate to the exhaust air; and a hydrophilic body belonging to the dispersal device, which projects into the process airflow and is impinged upon by said condensate in such a manner that it is not necessary for a user to separately dispose of said condensate.

2. The exhaust air dryer of claim 1, where the dispersal device is downstream of the heat exchanger in the airflow direction, wherein said dispersal device is positioned and arranged to direct said condensate to the air outlet.

3. The exhaust air dryer of claim 1, where the dispersal device comprises an ultrasound nebulizer.

4. The exhaust air dryer of claim 1, where the body is immersed in the condensate.

5. The exhaust air dryer of claim 1, where the body comprises capillaries, a capillary effect of which conveys condensate into the process airflow.

6. The exhaust air dryer of claim 1, where the body comprises an airflow-directing plate.

7. The exhaust air dryer of claim 1, wherein the heat exchanger is part of a heat pump.

* * * * *